US007510426B2

(12) United States Patent
Hwang et al.

(10) Patent No.: US 7,510,426 B2
(45) Date of Patent: Mar. 31, 2009

(54) ELECTRICAL POWER APPARATUS WITH RETRACTABLE CORDS AND MOVEABLE SOCKETS

(76) Inventors: Mina Hwang, 998 Ramblewood Dr., Coral Springs, FL (US) 33071; Dan M. DeLaRosa, 998 Ramblewood Dr., Coral Springs, FL (US) 33071

( * ) Notice: Subject to any disclaimer, the term of this patent is extended or adjusted under 35 U.S.C. 154(b) by 0 days.

(21) Appl. No.: 11/805,349

(22) Filed: May 23, 2007

(65) Prior Publication Data

US 2007/0275603 A1 Nov. 29, 2007

Related U.S. Application Data

(60) Provisional application No. 60/808,448, filed on May 26, 2006.

(51) Int. Cl.
*H01R 13/72* (2006.01)

(52) U.S. Cl. ..... 439/501; 191/12.4

(58) Field of Classification Search ..... 439/131, 439/501; 191/12.2, 12.4
See application file for complete search history.

(56) References Cited

U.S. PATENT DOCUMENTS 3,566,332 A * 2/1971 Bonhomme ..... 439/501
5,334,033 A * 8/1994 Milan ..... 439/214
5,700,158 A * 12/1997 Neiser et al. ..... 439/501
5,701,981 A * 12/1997 Marshall et al. ..... 191/12.4
5,723,815 A * 3/1998 Pena ..... 174/53
6,062,880 A * 5/2000 Skuza ..... 439/131
6,179,665 B1 * 1/2001 Rossman et al. ..... 439/654
6,567,273 B1 * 5/2003 Liu et al. ..... 361/737
6,568,946 B1 * 5/2003 Chou ..... 439/131
6,854,989 B2 * 2/2005 Milan ..... 439/131
7,189,107 B1 * 3/2007 Strayer et al. ..... 439/501
7,309,834 B1 * 12/2007 Byrd ..... 174/53

* cited by examiner

*Primary Examiner*—Thanh-Tam T Le
(74) *Attorney, Agent, or Firm*—Dan M. DeLa Rosa

(57) ABSTRACT

An electrical power apparatus is provided, the apparatus comprises: a housing comprising a top portion, a bottom portion and side walls, the housing having at least one indentation situated at the top portion and a slot situated on the side wall; and at least one socket component connected to a retractable cord, the socket component being situated within the indentation of the housing at a first position perpendicular to the bottom portion of the housing and moveable to the slot of the housing at a second position parallel to the bottom portion of the housing, and at a third position wherein the cord is extended and there is a distance between the socket component and the housing.

14 Claims, 6 Drawing Sheets

5a
5
5b
4
8
5
22
5
1

7
5
5
9
6
90°
2
5
4
9
5
4
5
5

ELECTRICAL POWER APPARATUS WITH RETRACTABLE CORDS AND MOVEABLE SOCKETS

RELATED APPLICATION

This application is related to U.S. Provisional Patent Application Ser. No. 60/808,448, entitled "Electrical Power Apparatus with Retractable Cords and Moveable Sockets" which was filed on May 26, 2006.

BACKGROUND OF THE INVENTION

1. Field of the Invention

This invention relates to an electrical power apparatus and more particularly, a surge protector having retractable cords and rotatable or moveable sockets. More specifically, the present invention relates to an electrical power apparatus comprising: a housing comprising a top portion, a bottom portion and side walls, the housing having at least one indentation situated at the top portion and a slot situated on the side wall; and at least one socket component connected to a retractable cord, the socket component being situated within the indentation of the housing at a first position perpendicular to the bottom portion of the housing and moveable to the slot of the housing at a second position parallel to the bottom portion of the housing, and at a third position wherein the cord is extended and there is a distance between the socket component and the housing.

2. Description of the Related Art

There are some surge protectors with retractable power cords in the prior art which utilizes a reel based mechanism. There are also wall mounted receptacles with retractable cords using cord reel assemblies. There are also surge protectors with a plurality of socket components attached to a plurality of cords which are connected to the housing of the surge protector.

Unlike the prior art, the present invention provides for an electrical power apparatus with moveable socket components capable of multiple angles in relation to the housing and further comprising socket components having retractable cords.

SUMMARY OF THE INVENTION

In one embodiment, the present invention relates to an electrical power apparatus comprising: a housing comprising a top portion, a bottom portion and side walls, the housing having at least one indentation situated at the top portion and a slot situated on the side wall; and at least one socket component connected to a retractable cord, the socket component being situated within the indentation of the housing at a first position perpendicular to the bottom portion of the housing and moveable to the slot of the housing at a second position parallel to the bottom portion of the housing, and at a third position wherein the cord is extended and there is a distance between the socket component and the housing.

In another embodiment, the socket component comprises a head and a stem, and the stem is connected to the retractable cord. In yet another embodiment, the stem of the socket component is designed to sit within the slot allowing the head to be situated adjacent to the side wall of the housing. In still another embodiment, the top portion and bottom portion of the housing forms an internal cavity, and the indentation has an aperture, the cord is situated within the aperture and the internal cavity during a non-extended position.

In still yet another embodiment, the apparatus further comprises a surge protector and a power source, the surge protector is designed to protect electrical devices connected to the socket components from electrical surges from the power source.

In a further embodiment, the socket component comprises a means for retracting the cord. In yet a further embodiment, the apparatus further comprises an electrical power cord attached to the housing. In still a further embodiment, the electrical power cord is a retractable cord and comprises a means for retracting the electric power cord. In still yet a further embodiment, the apparatus further comprising a visual power signal source.

In another further embodiment, the present invention relates to an electrical power apparatus comprising: an elongated housing comprising a top portion, a bottom portion and at least one set of opposing side walls, the housing has at least one indentation situated at the top portion and at least two slots, each slot being situated adjacent to the indentation and situated on each of the opposing side wall; and at least one socket component connected to a retractable cord, the socket component being situated within the indentation of the housing at a first position perpendicular to the bottom portion of the housing and moveable to the first slot of the housing at a second position parallel to the bottom portion of the housing, the socket component is moveable to the second slot at a third position parallel to the bottom portion of the housing and at a fourth position wherein the cord is extended and there is a distance between the socket component and the housing.

In yet another further embodiment, the present invention provides for electrical power apparatus comprising: an elongated housing comprising a top surface portion and at least one set of opposing side walls; and a plurality of socket components, each of the socket component being situated on the top surface portion of the housing at a first position and moveable to a second position parallel at one side of the opposing sidewalls of the housing, each of the socket components being moveable to a third position to a second side of the opposing sidewalls of the housing. In this embodiment, the socket component is moveable about 180 degrees.

In still another further embodiment, at least one of the socket components comprises a retractable cord. In still yet another further embodiment, at least one of the socket components is moveable to a fourth position wherein the cord is extended creating a distance between the socket component and the housing.

In another embodiment, the apparatus further comprises a surge protector, a power source and electrical power cord, and the surge protector designed to protect electrical devices connected to the socket components from electrical surges from the power source.

In a further embodiment, the present invention further provides an electrical power apparatus comprising: a housing comprising a top portion and at least one side wall; and at least one socket component connected to a retractable cord, the socket component being situated at a first position on the top portion of the housing and moveable to a second position on the side wall of the housing, and at a third position wherein the cord is extended creating a distance between the socket component and the housing.

In the above mentioned embodiment, the socket component is moveable about 90 degrees. In another embodiment, the user may pull on the socket component thereby extending the cord to a certain length and then locks into place; when the user is done using the socket component, the user then again pulls or tugs on the socket component and the cord will then retract back into the housing.

In a further embodiment, the retractable cord attached to the socket component can use any means for retraction including, but not limited to, cord reels, cord pins, mechanisms utilized in retractable cords for vacuum cleaners, etc.

In another further embodiment, the side walls comprises a securing means such as pins, clips, etc. for securing the retractable cord of the socket component when the socket component is in an extended position.

In a further embodiment, the apparatus comprises tracks on which the retractable cords sit and ride during extension and retraction. These tracks are situated within the housing of the apparatus.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figures 1, 2:
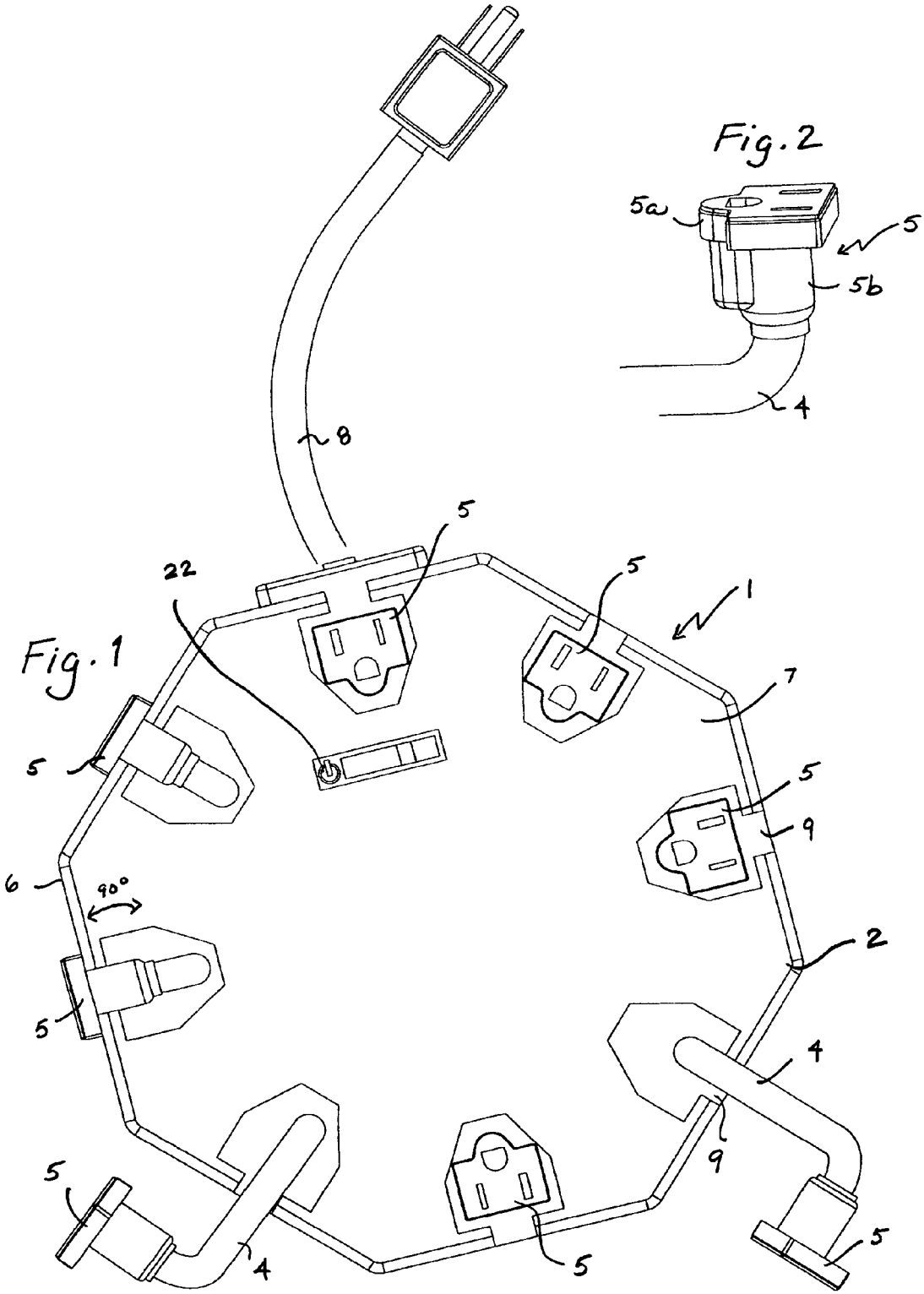
FIG. 1 is an overhead view of one of the embodiments of the present invention.
FIG. 2 is a perspective view of one of the embodiments of the socket component of the present invention.

FIG. 1 illustrates an overhead view of one of the embodiments of the electrical power apparatus 1 of the present invention. The electrical power apparatus 1 comprises: a housing 2 comprising a top portion 7 and at least one side wall 6; and at least one socket component 5 connected to a retractable cord 4, the socket component 5 being situated at a first position on the top portion 7 of the housing 2 and moveable to a second position on the side wall 6 of the housing 2, and at a third position wherein the cord 4 is extended creating a distance between the socket component 5 and the housing 2.

The socket component 5 is moveable about 90 degrees. The user may pull on the socket component 5 thereby extending the cord 4 to a certain length and then locks into place; when the user is done using the socket component 5, the user then again pulls or tugs on the socket component sand the cord 4 will then retract back into the housing 2.

FIG. 2 shows one embodiment of the socket component 5; the socket component 5 comprises a head 5*a* and a stem 5*b*, and the stem 5*b* is connected to the retractable cord 4.

Figure 3:
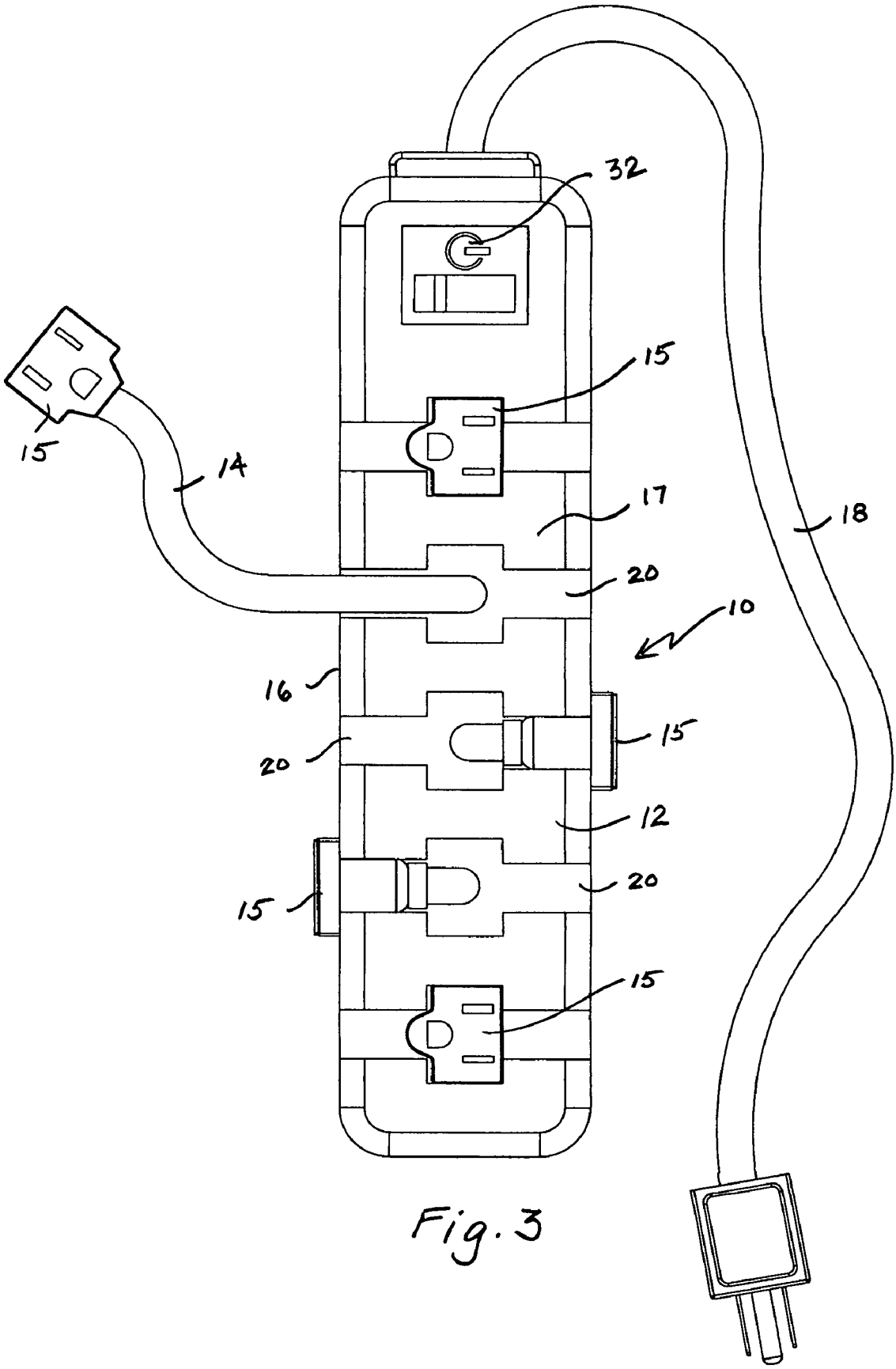
FIG. 3 is an overhead view of another embodiment of the present invention showing an elongated housing.

FIG. 3 illustrates another embodiment of the electrical power apparatus 10 of the present invention using an elongated housing 12. The electrical power apparatus 10 comprises: an elongated housing 12 comprising a top surface portion 17 and at least one set of opposing side walls 16*a* and 16*b* respectively; and a plurality of socket components 15, each of the socket components 15 being situated at a first position on the top surface portion 17 of the housing 12 and moveable to a second position on one side 16*a* of the opposing sidewalls of the housing 12, each of the socket components 15 being moveable to a third position to a second side 16*b* of the opposing sidewalls of the housing 12. In this embodiment, the socket components 15 are moveable about 180 degrees.

Figure 4:
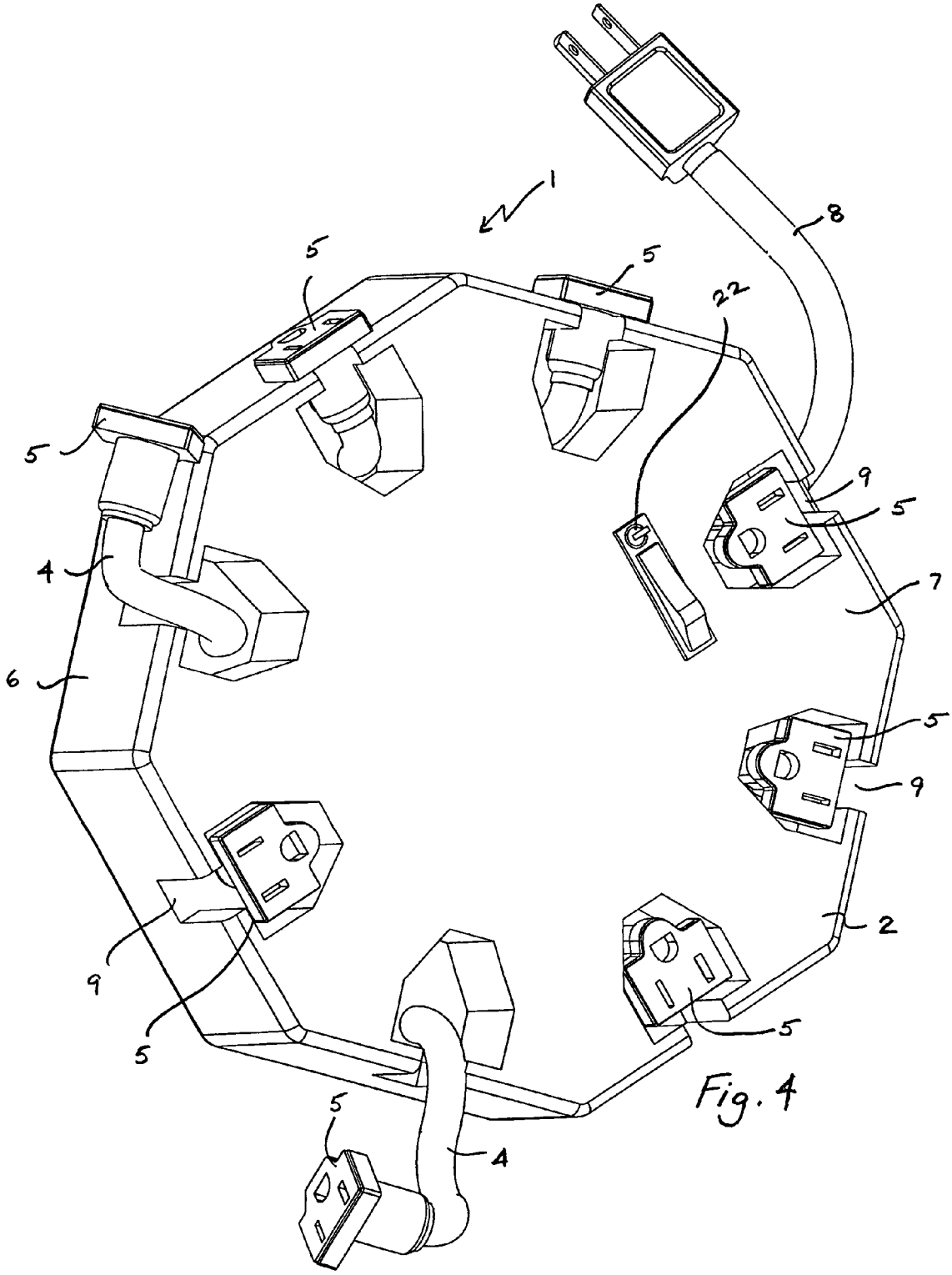
FIG. 4 is a perspective view of FIG. 1.

FIG. 4 illustrates a perspective view of FIG. 1. The electrical power apparatus 1 comprises: a housing 2 comprising a top portion 7 and at least one side wall 6; and at least one socket component 5 connected to a retractable cord 4, the socket component 5 being situated at a first position on the top portion 7 of the housing 2 and moveable to a second position on the side wall 6 of the housing 2, and at a third position wherein the cord 4 is extended creating a distance between the socket component 5 and the housing 2. The cord 4 is retractable allowing for a first position wherein the socket component 5 and cord 4 are in a retracted position and a second position wherein the cord 4 is extended away from the housing allowing for an extended position. The visual power signal source 22 is situated on the top portion 7 of the housing 2. There are indentations 9 which allow the socket components to be in the second position on the side wall 6 of the housing 2. An electrical power cord 8 is also attached to the housing 2.

Figure 5:
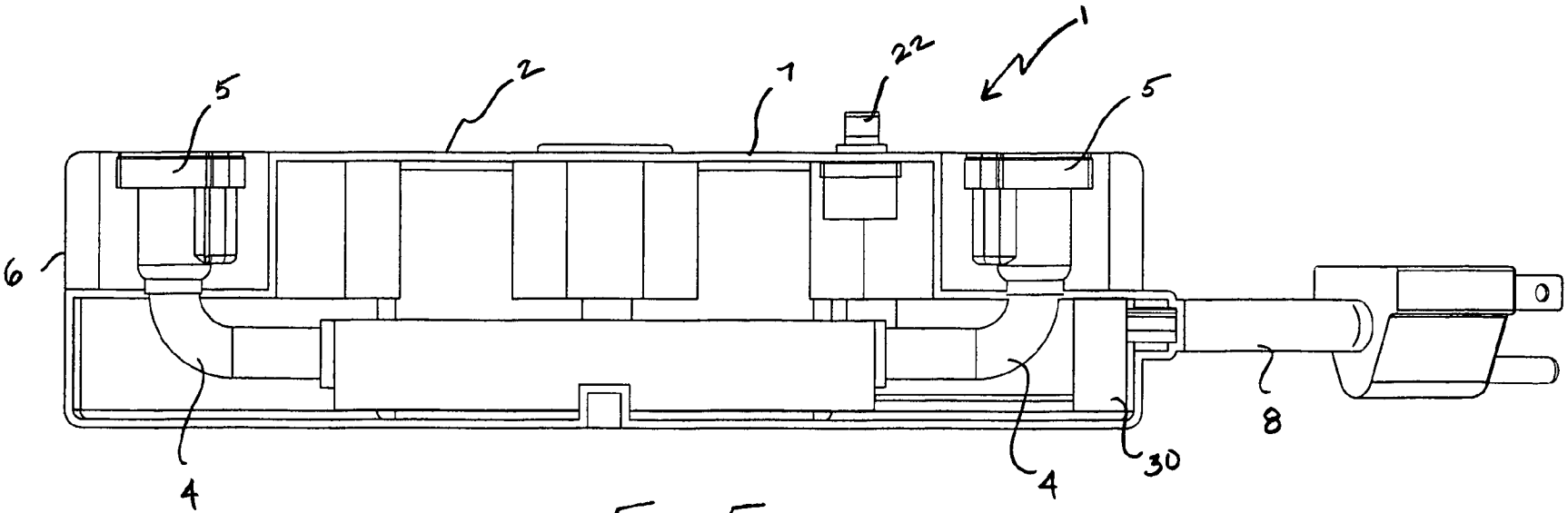
FIG. 5 is a cutaway side view of FIG. 1.

FIG. 5 illustrates a cutaway side view of FIG. 1. The electrical power apparatus 1 further comprises a surge protector 30 and a power source such as an electrical outlet. The visual power signal source 22 is situated on the top portion 7 of the housing 2 and an electrical power cord 8 is also attached to one of the side walls 6 the housing 2. FIG. 5 also shows the retractable electrical power cord 8.

Figure 6:
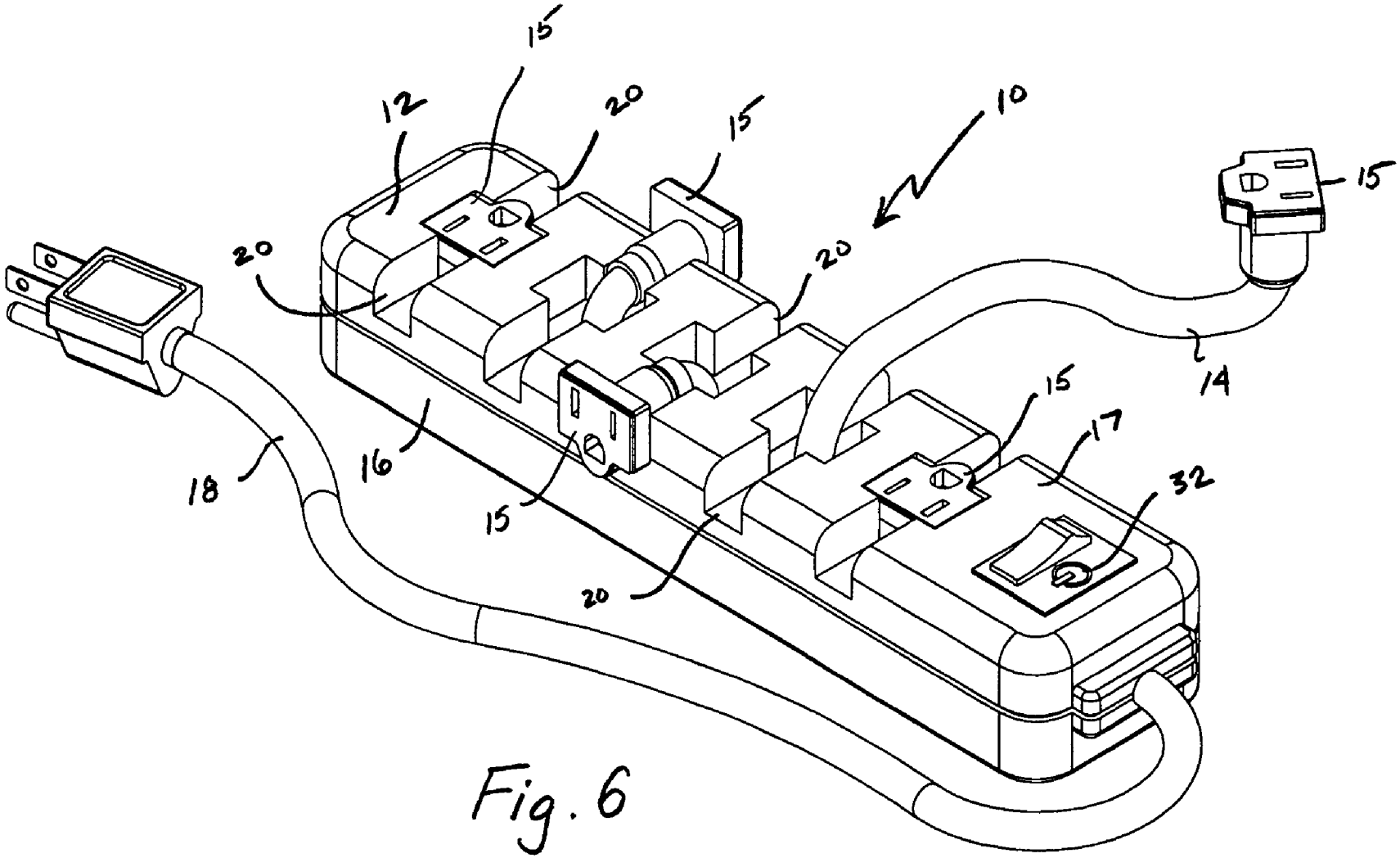
FIG. 6 is a perspective view of FIG. 3.

FIG. 6 illustrates a perspective view of FIG. 3. The electrical power apparatus 10 comprises: an elongated housing 12 comprising a top surface portion 17 and at least one set of opposing side walls 16*a* and 16*b* respectively; and a plurality of socket components 15, each of the socket components 15 being situated at a first position on the top surface portion 17 of the housing 12 and moveable to a second position on one side 16*a* of the opposing sidewalls of the housing 12, each of the socket components 15 being moveable to a third position to a second side 16*b* of the opposing sidewalls of the housing 12. In this embodiment, the socket components 15 are moveable about 180 degrees. At least one of the socket components 15 is attached to a cord 14. The cord 14 is retractable allowing for a first position wherein the socket component 15 and cord 14 are in a retracted position and a second position wherein the cord 14 is extended away from the housing allowing for an extended position. The visual power signal source 32 is situated on the top portion 17 of the housing 12. There are indentations 20 which allow the socket components 15 to be in the second position on the side wall 16 of the housing 12. An electrical power cord 18 is also attached to the housing 12.

Figure 7:
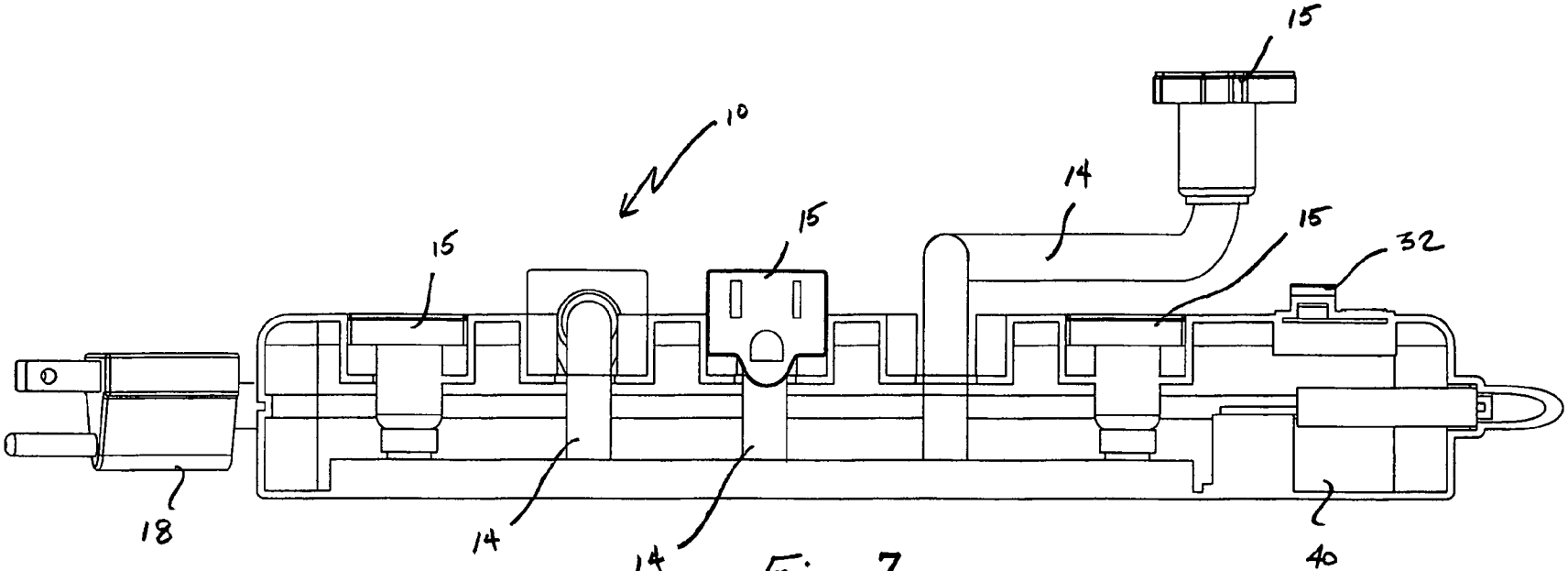
FIG. 7 is a cutaway side view of FIG. 3.

FIG. 7 illustrates a cutaway side view of FIG. 3. The electrical power apparatus 10 further comprises a surge protector 40 and a power source such as an electrical outlet. The visual power signal source 32 is situated on the top portion 17 of the housing 12 and an electrical power cord 18 is also attached to one of the side walls 16 the housing 12. FIG. 5 also shows the retractable electrical power cord 18.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. An electrical power apparatus comprising:

a housing comprising a top portion and at least one side wall;

at least one surge protector situated within said housing; and at least one socket component connected to a retractable cord, said socket component being situated at a first position on the top portion of said housing and moveable to a second position on said side wall of said housing, and at a third position wherein said cord is extended creating a distance between said socket component and said housing;

wherein said housing further comprises a bottom portion, a slot situated at said top portion and at least one indentation situated on said side wall, said socket component being situated within said slot of said housing at said first position perpendicular to said bottom portion of said housing and moveable to said at least one indentation of said housing at said second position parallel to said bottom portion of said housing, and at said third position wherein said cord is extended and there is the distance between said socket component and said housing.

2. The apparatus of claim 1 wherein said socket component comprises a head and a stem, said stem being connected to said retractable cord, said stem of said socket component being designed to sit within said indentation allowing said head to be situated adjacent to said side wall of said housing.

3. The apparatus of claim 1 wherein said top portion and said bottom portion of said housing forms an internal cavity, said slot having an aperture, said cord being situated within said aperture and said internal cavity during a non-extended position.

4. The apparatus of claim 1 further comprising a power source and at least one an electrical power cord, said surge protector designed to protect electrical devices connected to said socket components from electrical surges from said power source, said electrical power cord adapted to be plugged into said power source during use.

5. The apparatus of claim 4 wherein said electrical power cord is a retractable cord and comprises a means for retracting said electric power cord.

6. The apparatus of claim 1 wherein said socket component comprises a means for retracting said cord.

7. The apparatus of claim 1 further comprising a visual power signal source.

8. The apparatus of claim 1 wherein electrical power cord is a retractable cord and comprises a means for retracting said electric power cord.

9. An electrical power apparatus comprising:

an elongated housing comprising a top portion, a bottom portion and at least one set of opposing side walls, said housing having at least one slot situated at said top portion and at least two indentations, each indentation being situated adjacent to said slot and situated on each of said opposing said side wall; and at least one socket component connected to a retractable cord, said socket component being situated within said slot of said housing at a first position perpendicular to said bottom portion of said housing and moveable to one of said two indentations of said housing at a second position parallel to said bottom portion of said housing, said socket component is moveable to other of said two indentations at a third position parallel to said bottom portion of said housing and at a fourth position wherein said cord is extended and there is a distance between said socket component and said housing.

10. The apparatus of claim 9 wherein said socket component comprises a head and a stem, said stem being connected to said retractable cord.

11. The apparatus of claim 10 wherein said stem of said socket component being designed to sit within said indentation allowing said head to be situated adjacent to said side wall of said housing.

12. The apparatus of claim 10 wherein said socket component comprises a means for retracting said cord.

13. The apparatus of claim 10 further comprising a surge protector, a power source and electrical power cord, said surge protector designed to protect electrical devices connected to said socket components from electrical surges from said power source, said electrical power cord adapted to be plugged into said power source during use.

14. The apparatus of claim 10 further comprising a visual power signal source.

* * * * *